US005343582A

United States Patent [19]

Baylor

[11] Patent Number: 5,343,582

[45] Date of Patent: Sep. 6, 1994

[54] HAIR STYLE PROTECTING HEAD REST

[76] Inventor: Avery L. Baylor, Rte. 2 Box 838, Colonial Beach, Va. 22443

[21] Appl. No.: 125,172

[22] Filed: Sep. 23, 1993

[51] Int. Cl.[5] ..... A47G 9/00

[52] U.S. Cl. ..... 5/639; 5/636; 5/642; 5/643

[58] Field of Search ..... 5/639, 636, 638, 640, 5/642, 643

[56] References Cited

U.S. PATENT DOCUMENTS 3,035,279 5/1962 Stead ..... 5/639
3,148,386 9/1964 Shebib ..... 5/636
3,283,344 11/1966 Blanchard ..... 5/639
3,296,634 1/1967 Rusnak ..... 5/639
3,337,883 8/1967 Allison ..... 5/638
3,480,976 12/1969 Yavner ..... 5/639

*Primary Examiner*—Alexander Grosz
*Attorney, Agent, or Firm*—Dowell & Dowell

[57] ABSTRACT

A head rest for supporting an individual's head when resting or sleeping to protect their coiffure which includes a pivoted base from which vertically extend a first "comb-like" cradle for engaging the individual's head above their ears and a second cushioned pad for engaging the head below the ears.

20 Claims, 2 Drawing Sheets

HAIR STYLE PROTECTING HEAD REST

BACKGROUND OF THE INVENTION

1. Field of the Invention

This invention is generally directed to head rest supports and more specifically to supports of the type which are designed to elevate the head in order to protect an individual's coiffure. The device of the present invention is intended for use when an individual is sleeping or resting to support the head so that the individual's hair is not matted or crushed against a surface such as a pillow or mattress and thus elevates the head without interfering with the individual's hair style.

2. History of the Related Art

There are many occasions when individuals find it necessary to have their hair stylized for social and other functions a day or two prior to the event. In these situations, individuals desire to maintain or protect their coiffure which is extremely difficult especially during periods when the individuals are sleeping. In the past, many individuals simply slept in a seated position so as not to mat or mess their hair. In other instances, a pillow or other object may be placed under the nape of the neck and no support is provided to the upper portion of the head. However, resting or sleeping with only a support under the neck can result in a stiff neck and discomfort and pain.

In order to overcome the deficiencies in the prior art, it has been proposed to provide modified head rests for purposes of supporting an individual's head to either protect their hair style or to make sleeping more comfortable when rollers or other objects are placed in the hair to create a hair style. U.S. Pat. No. 3,035,279 to Stead discloses a head rest having a shoulder rest from which extends a fan shaped comb device having a plurality of spaced fingers which extend outwardly beyond the nape of the neck to a position in which the comb extends into the hair and provides a support for the back of the head when the head rest is in use. Unfortunately, this type of device only provides proper support for the head when the individual is reclined on their back. This limits a person to one sleeping position which is not a practical solution to protecting the hair style during periods of rest.

In U.S. Pat. No. 3,283,344 to Blanchard a similar type of head rest is disclosed which includes a cushion for engaging the nape or back of the neck and a series of "comb-like" fingers which extend through the hair which provide a yieldable support for the back of the head. Again, the sleeping position of the individual is restricted and therefore this device is also not a practical solution to the problem of protecting the hair style. Another head rest which is engagable with the nape of the neck and which is provided with "comb-like" fingers which extend through the hair for supporting the back of an individual's head from a surface is disclosed in U.S. Pat. No. 3,296,634 to Rusnak.

A variation of previously mentioned head rests for supporting an individual's head is disclosed in U.S. Pat. No. 3,480,976 to Yavner. Yavner's device includes a u-shaped cushion which surrounds the individual's neck and provides primary support at the back of the neck. The device further includes a "comb-like" structure which, like the aforementioned prior art devices, supports the back of the individual's head when the individual is reclined. Again, this type of device does not provide a support which would enable a person to protect their hair style and yet sleep in a variety of positions, such as on their back or on their sides.

SUMMARY OF THE INVENTION

A head rest for supporting an individual's head in an elevated position when they are reclined which includes a base having two sections which are hingedly connected to one another so that the base portions may conform to the shape of a supporting surface. A "comb-like" cradle is resiliently mounted to a first base section on a pair of spaced vertically extending posts which extend from the first base section. The cradle includes a plurality of "comb-like" teeth which are inserted into the coiffure of an individual when the device is in use so that an individual when lying down will have the upper portion of their head above their ears supported in the cradle. In the preferred embodiment, the cradle is formed with a generally concave upper surface so as to more comfortably conform to the shape of the individual's head. A second support member is resiliently mounted to the other or second base section and includes an elongated cushion pad which is retained in vertically spaced relationship with respect to the base by a pair of spaced posts which extend upwardly from the second base section. The cushioned pad is utilized to provide support for the head below the individual's ears and may be engagable with the back of the head adjacent the nape of the neck or along the side of the face in the area of the right or left cheek.

It is the primary object of the present invention to provide a head rest support which may be utilized by an individual while resting or sleeping in a reclined position on a support surface and which supports the individual's head so that their coiffure is elevated and not adversely affected by being forced or matted against the support surface and wherein the head rest may be utilized to support the head when the individual is lying on his or her back or left or right side.

It is another object of the present invention to provide a comfortable head rest support which may be utilized by an individual desiring to protect their stylized hair from being disturbed when they are resting or sleeping and which includes a pair of spaced resiliently mounted support surfaces, one of which will cradle the head above the ears and another which cradles the head below the ear line.

It is also an object of the present invention to provide head rest support which includes a pair of elevated support members for supporting the head at spaced areas wherein the device includes a comb member which is engagable into the hair prior to the individual reclining so that the head rest may be properly aligned with the head prior to its use.

DESCRIPTION OF THE PREFERRED EMBODIMENT

Figure 1:
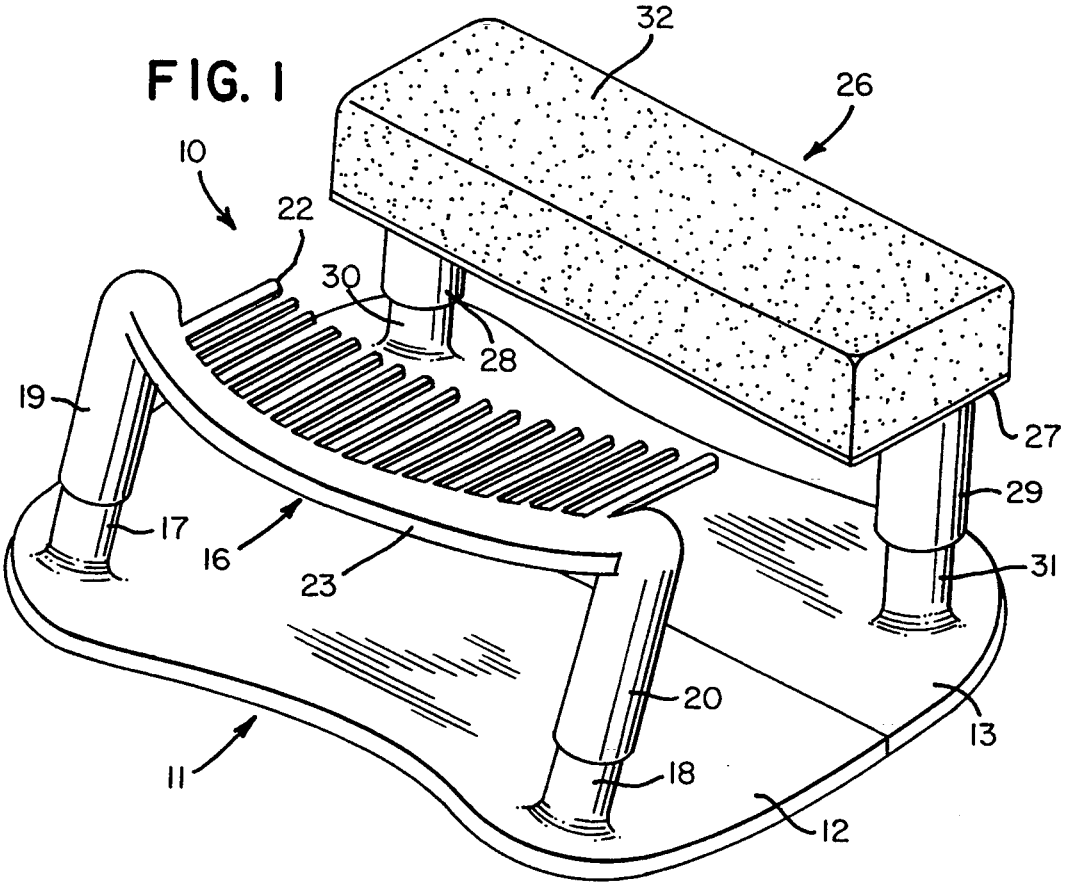
FIG. 1 is a top perspective view of the head rest of the present invention.
Figure 2:
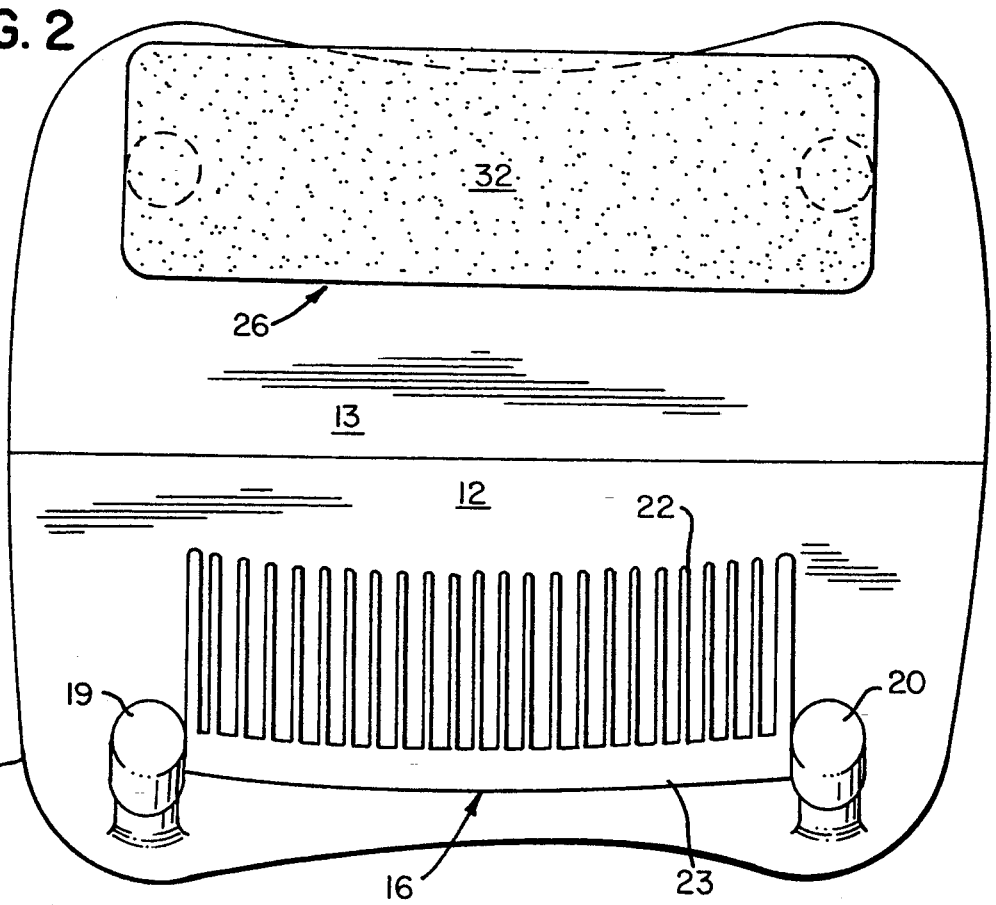
FIG. 2 is a top plan view of the head rest shown in FIG. 1.
Figure 3:
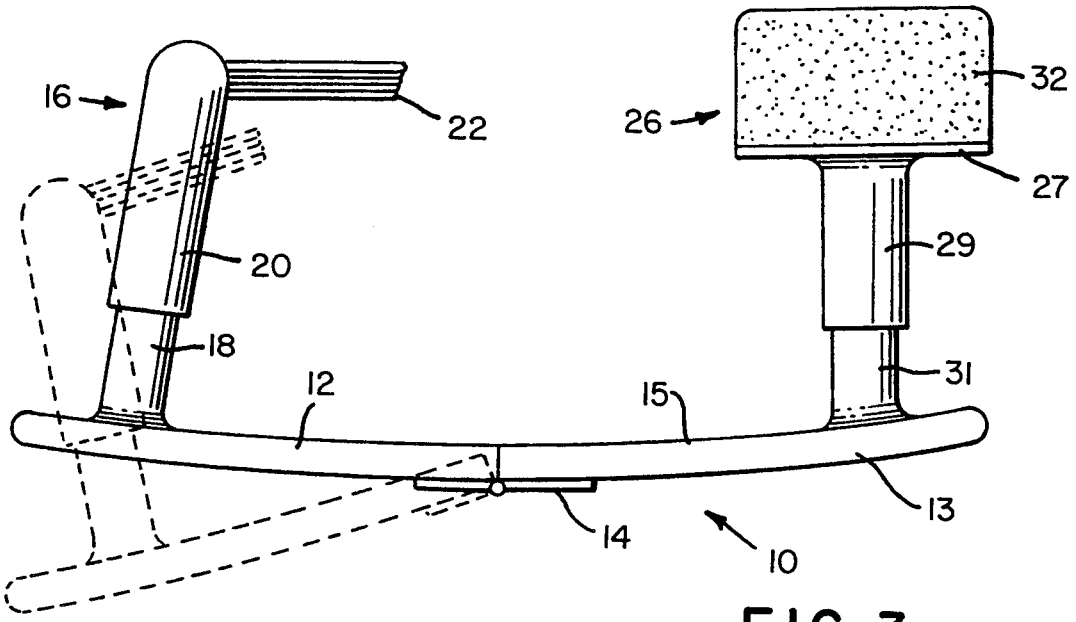
FIG. 3 is a side elevational view of the head rest of the present invention showing the relative movement between the base sections in dotted line.
Figure 4:
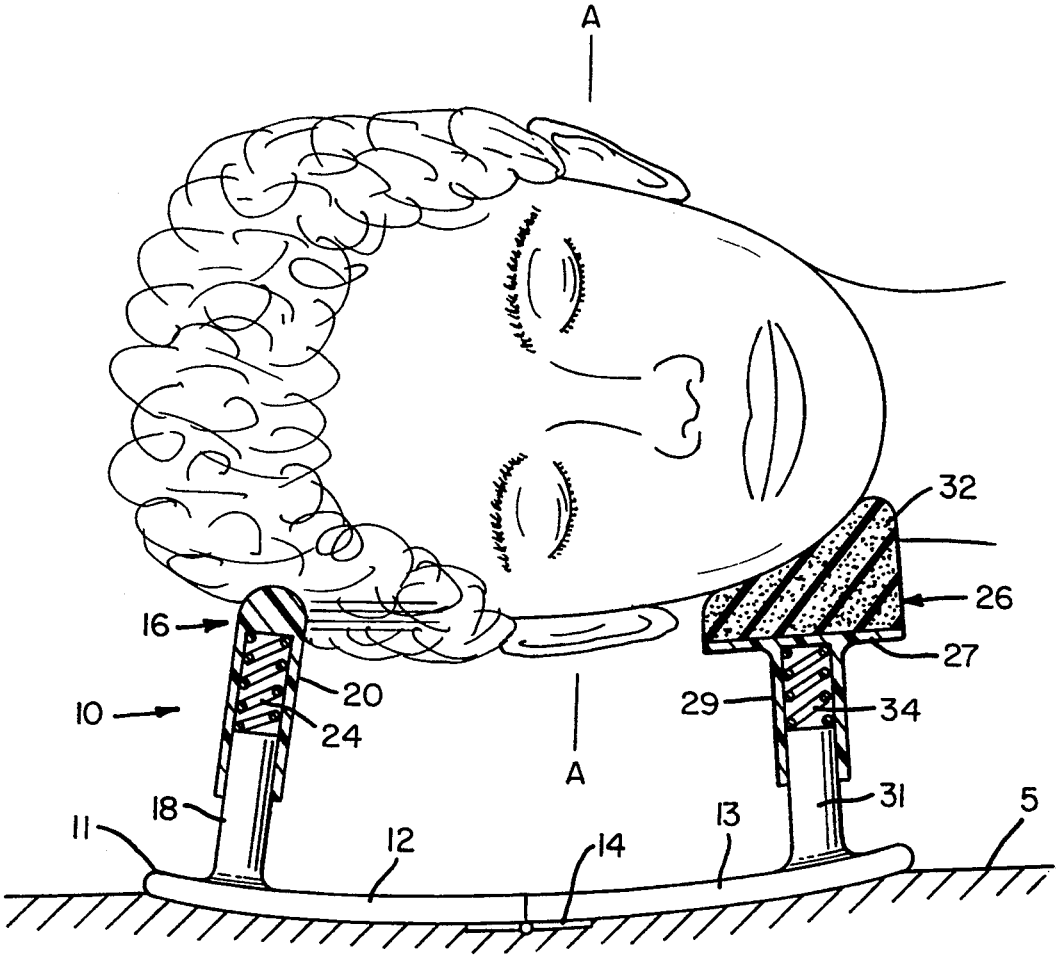
FIG. 4 is a cross-sectional illustrational view showing the head rest of the present invention in use.

The head rest 10 of the present invention is shown as including a base 11 having a pair of sections 12 and 13 which are joined by a hinge assembly 14 which is mounted to the sections on the underside thereof, as is shown in FIGS. 3 and 4. The hinge allows the two sections to pivot relative to one another as is shown in dotted line in FIG. 3. The hinged sections allow the base to more evenly conform to a support surfaces, as is shown in FIG. 4. The base may be constructed to be somewhat yieldable and is preferably formed of a plastic material. As shown in FIGS. 3 and 4, the upper surface 15 of the base is slightly concave in configuration. The shape of the base may vary and the configuration shown in the drawing figures is for purposes of illustration only.

The head rest of the present invention is uniquely designed to provide support along two spaced areas of an individual's head, as is shown in FIG. 4. In this respect, a first "comb-like" cradle 16 is provided which is resiliently mounted to a pair of spaced vertical support posts 17 and 18 which are preferably integrally molded with the base portion 12. The cradle includes a pair of mounting sleeves 19 and 20 which extend downwardly from both end thereof and which are of the size to be seated about the posts 17 and 18, respectively. The cradle 16 further includes a plurality of spaced elongated teeth 22 which extend from a support bar 23. The cradle is shown as having a generally concave configuration along its upper surface to comfortably conform to an individual's head. The teeth 22 are designed to be inserted into an individual's coiffure, as is shown in FIG. 4, so that the primary weight of the upper portion of the individual's head is supported by the teeth. The teeth will ensure that the support is retained in position once the teeth are inserted into the hair and will provide support for the upper portion of the head without adversely affecting the individual's coiffure. The teeth may vary in lengths, however, lengths of between 1 to 3 inches are preferred.

The cradle 16 is preferably resiliently mounted to the base section 12 by a pair of spring elements 24 which are provided between the posts 17 and 18 and the sleeves 19 and 20. By providing a resilient support for the cradle 16, the cradle will be raised and lower automatically to compensate for any changes of forces created as an individual shifts their head while resting or sleeping. As opposed to the spring shown in the drawings, other types of resilient shock absorbing elements could be utilized and fall within the teachings of the present invention.

As noted, the cradle supplies the primary support for the upper portion of the head. The device is designed to allow an individual to sleep on their sides or on their back. In drawing FIG. 4, the invention is shown as illustrated and supporting an individual resting on their side. If the device is utilized when an individual is resting on their back, the teeth of the "comb-like" cradle are simply engaged with the hair along the back of the head as opposed to the side of the head above the ear line as is shown in FIG. 4. For purposes of definition, the ear line is generally taken along axis "A—A", as shown in FIG. 4.

To provide support for the lower portion of an individual's head, the present invention includes a support pad 26 having a backing element 27 which is preferably molded of plastic material and from which extend a pair of cylindrical sleeves 28 and 29 which are integrally molded thereto. The sleeves 28 and 29 are of the size to receive a pair of support posts 30 and 31 which are preferably integrally molded and extend vertically from the base section 13. The pad further includes a foam or similar resilient rest 32 which is mounted to the backing element 27.

As shown in FIG. 4, the support pad 26 is designed to engage an individual's head below the ear line either in the area of the back of the head adjacent the nape of the neck or along the right or left cheek. Although a foam rest 32 is shown in the drawings, other types of resilient or soft flexible supports may be provided. As with the cradle 16, the support pad 26 is resiliently mounted to the support posts 30 and 31 by providing spring elements 34 between the support posts 30 and 31 and the sleeves 28 and 29.

Although the preferred embodiment discloses the use of a pair of sleeves and support posts for supporting both the cradle and the support pad relative to the base, in some instances a single post and sleeve arrangement may be used. Likewise, three or more post and sleeve arrangements may be utilized. Further, as opposed to forming the sleeves with the cradle and the support pad, the sleeves may be formed with the base sections and the posts formed with the cradle and support pad. In addition, although the upper surface of the cradle and the cushion of the support pad are generally equally elevated with respect to the base sections, in some embodiments either the cradle or the support pad may be raised or lowered slightly to change their relative positioning.

In use, the head support of the present invention is initially engaged and the pad portion 26 pivoted away from the cradle 16 and the teeth of the cradle urged into the individual's coiffure depending upon the position in which the individual wants to rest or sleep. If an individual wants to rest on their right cheek as is shown in FIG. 4, the comb is inserted into the hair line along the upper portion of the side of the head above the ear line. In this position, the comb will support the device as the individual reclines. Thereafter, the cheek is placed against the support pad 26 to thereby support the individual's head below the ear line. When the individual desires to shift from their side to their back or to their opposite side, it is only necessary to remove the cradle and reinsert the teeth of the cradle into the hair at a different location, such as the back of the head or the opposite side of the head.

I claim:

1. A head rest apparatus for supporting an individual's head when resting to protect their coiffure and which supports the head both above and below the ear line, the apparatus comprising, a base having upper and lower surfaces, a cradle support means having a plurality longitudinal extending teeth, means for mounting said cradle support means in spaced relationship from said upper surface of said base, said cradle support means being selectively engagable with the individual's head above the ear line, a second support means said second support means being spaced apart from and discontinuous from said cradle support means, means for mounting said second support means in spaced relationship with respect to said upper surface of said base whereby said second support means is engagable with the individual's head or neck below the ear line when the apparatus is in use.

2. The head rest apparatus of claim 1 in which said base includes first and second sections, hinge means for connecting said first and second sections, said hinge means being mounted so as to allow said first and second sections to pivot such that said cradle support means and said second support means move outwardly relative to one another.

3. The head rest apparatus of claim 1 in which said teeth of said cradle support means form an upper generally concave surface.

4. The head rest apparatus of claim 3 in which said means for mounting said cradle support means includes at least one first sleeve and a first post extending between said cradle support means and said base, and first resilient means mounted intermediate said first sleeve and first post for resiliently supporting said cradle support means relative to said base.

5. The head rest apparatus of claim 4 including a pair of first sleeves and first posts extending between said cradle support means and said base, and first resilient means mounted between each of said first sleeves and posts.

6. The head rest apparatus of claim 4 in which said means for mounting said second support means includes at least one second sleeve and a second post extending between said second support means and said base, and second resilient means mounted between said second sleeve and said second post for resiliently mounting said second support means to said base.

7. The head support rest apparatus of claim 5 including a pair of second sleeves and second posts extending between said second support means and said upper surface of said base, and second resilient means mounted between each of said second sleeves and said second posts for resiliently mounting said second support means relative to said base.

8. The head rest apparatus of claim 7 in which said teeth are oriented toward said second support means.

9. The head rest apparatus of claim 1 in which said means for mounting said cradle support means includes a resilient member.

10. The head rest apparatus of claim 9 in which said means for mounting said second support means includes a resilient member.

11. The head rest apparatus of claim 10 in which said base includes first and second sections, hinge means for connecting said first and second sections, said cradle support means being mounted to said first section and said second support means being mounted to said second section.

12. The head rest apparatus of claim 1 in which said second support means includes an elongated pad.

13. A head rest apparatus for supporting an individual's head when resting to protect their coiffure and which supports the head both above and below the ear line, the apparatus comprising, a base having upper and lower surfaces, a cradle support means, means for resiliently mounting said cradle support means in spaced relationship from said upper surface of said base, said cradle support means being selectively engagable with the individual's head above the ear line, a second support means spaced from said cradle support means, means for resiliently mounting said second support means in spaced relationship with respect to said upper surface of said base, said means for mounting said cradle support means includes at least one first sleeve and a first post extending between said cradle support means and said base, and first resilient means mounted intermediate said first sleeve and first post for resiliently supporting said cradle support means relative to said base, said means for mounting said second support means includes at least one second sleeve and a second post extending between said second support means and said base, and second resilient means mounted between said second sleeve and said second post for resiliently mounting said second support means to said base, whereby said second support means is engagable with the individual's head or neck below the ear line when the apparatus is in use.

14. The head rest apparatus of claim 13 in which said base includes first and second sections, hinge means for connecting said first and second sections, said hinge means being mounted so as to allow said first and second sections to pivot such that said cradle support means and said second support means move outwardly relative to one another.

15. The head rest apparatus of claim 13 including a pair of first sleeves and first posts extending between said cradle support means and said base, and first resilient means mounted between each of said first sleeves and posts.

16. The head support rest apparatus of claim 15 including a pair of second sleeves and second posts extending between said second support means and said upper surface of said base, and second resilient means mounted between each of said second sleeves and said second posts for resiliently mounting said second support means relative to said base.

17. The head rest apparatus of claim 16 in which said cradle support means includes a plurality of longitudinally extending teeth.

18. The head rest apparatus of claim 17 in which said teeth are oriented toward said second support means.

19. The head rest apparatus of claim 17 in which said base includes first and second sections, hinge means for connecting said first and second sections, said cradle support means being mounted to said first section and said second support means being mounted to said second section.

20. The head rest apparatus of claim 17 in which said second support means includes an elongated pad.

* * * * *